US007261328B2

(12) United States Patent
Minix

(10) Patent No.: US 7,261,328 B2
(45) Date of Patent: Aug. 28, 2007

(54) PUSH BUTTON LATCH RELEASE ASSEMBLY

(75) Inventor: C. Ricky Minix, Edwardsburg, MI (US)

(73) Assignee: Fastec Industrial Corp., Elkhart, IN (US)

( * ) Notice: Subject to any disclaimer, the term of this patent is extended or adjusted under 35 U.S.C. 154(b) by 102 days.

(21) Appl. No.: 11/147,251

(22) Filed: Jun. 8, 2005

(65) Prior Publication Data

US 2006/0082161 A1 Apr. 20, 2006

Related U.S. Application Data

(60) Provisional application No. 60/619,029, filed on Oct. 18, 2004.

(51) Int. Cl.
*E05C 7/00* (2006.01)

(52) U.S. Cl. ..... 292/28; 292/50; 292/DIG. 37; 296/100.07

(58) Field of Classification Search ..... 292/DIG. 37, 292/38, 50, 171, 28; 296/100.07, 100.16
See application file for complete search history.

(56) References Cited

U.S. PATENT DOCUMENTS 197,115 A 11/1877 Frees
2,839,912 A 6/1958 Corbin et al.
3,027,188 A 3/1962 Eichstadt
3,589,209 A * 6/1971 Howell ..... 74/501.6
4,892,338 A 1/1990 Weinerman et al.
6,006,560 A * 12/1999 DeVries ..... 70/208
6,309,008 B1 * 10/2001 Bacon ..... 296/106
6,427,500 B1 8/2002 Weinerman et al.
6,685,240 B2 2/2004 Bacon

* cited by examiner

*Primary Examiner*—Gary Estremsky
(74) *Attorney, Agent, or Firm*—Dykema Gossett PLLC

(57) ABSTRACT

A push button latch release assembly includes a push button actuator and a latch cord which extends through the push button actuator and connects at its opposite ends to release arms of respective rotary spring latches. The push button actuator includes a housing having a base and a tubular barrel, and a button cylinder which is axially movable in the barrel. The button cylinder includes a shaft which extends through a hole in the base of the housing and the base mounts two posts which are located on opposite sides of the shaft. The latch cord extends through respective guide channels in the posts and a passageway through the shaft. Pressing the button cylinder moves the shaft so that the latch cord is extended between the posts and the ends of the latch cord are drawn in, releasing the release arms.

13 Claims, 3 Drawing Sheets

15
20
51
56
50
57
14

2
17
13
20
14
2
11
15
10

FIG. 2
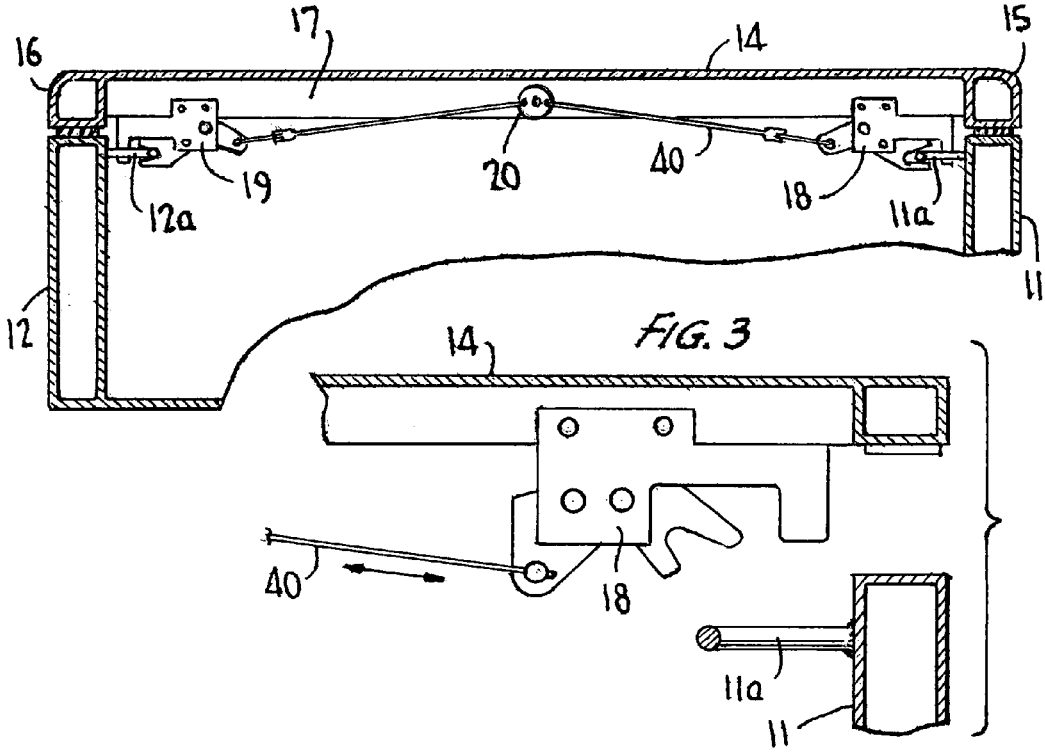
FIG. 3
FIG. 6
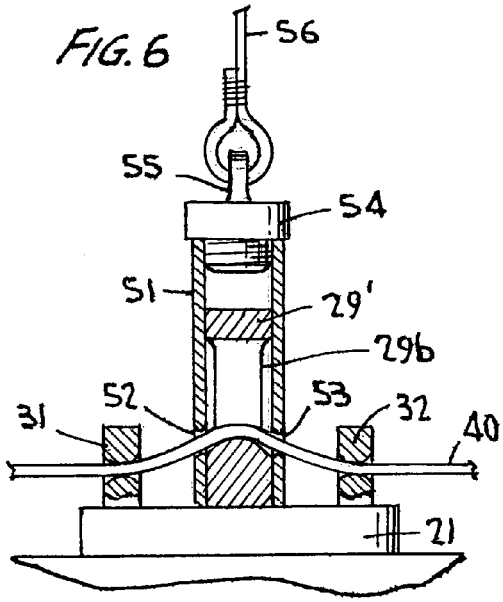
FIG. 7
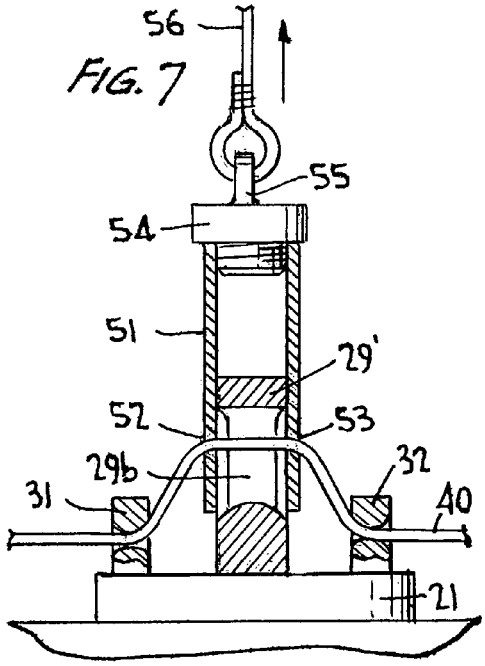

PUSH BUTTON LATCH RELEASE ASSEMBLY

CROSS-REFERENCE TO RELATED APPLICATION

This application claims the benefit of U.S. Provisional Application No. 60/619,029, filed Oct. 18, 2004.

BACKGROUND OF THE INVENTION

1. Field of the Invention

The present invention relates to latch release mechanisms, and more particularly to latch release mechanisms that can simultaneously release two separated latches.

2. The Prior Art

Latch release mechanisms capable of releasing two separated latches that connect two members together are well known. A mechanism of this type for barn releasing latches connecting a barn door to a barn was patented in 1877 (see U.S. Pat. No. 1,971,15). Latch release mechanisms of this type find modern use in unlatching doors of vehicles and industrial cabinets. See, for example, U.S. Pat. Nos. 2,839,912, 3,027,188, 4,892,338 and 6,685,240. Such mechanisms can be used in releasing the latches that are used to lock a tonneau cover in position over the bed of a truck. See, for example, U.S. Pat. No. 6,427,500.

However, the known mechanisms are in many cases complicated in construction, requiring many parts, or are too large in dimensions for many installation situations.

The present invention provides a latch release assembly which is simple in construction, inexpensive to manufacture, and small enough in dimensions that it can fit into a very small space.

SUMMARY OF THE INVENTION

According to this invention, the latch release assembly includes a push button actuator and a latch cord which extends through the push button actuator and connects at its ends to respective spring latches on opposite sides of the push button actuator. The push button actuator includes a housing and a button cylinder which fits within the housing and which includes a shaft that extends through a base of the housing, the shaft including a lateral passageway therethrough. Two posts with guide channels therethrough are positioned on opposite sides of the shaft. The latch cord extends through the guide channels and the passageway in the shaft. Pushing of an exposed end of the button cylinder against the action of a spring will cause its shaft to move and extend (lengthen) the latch cord between the posts. This in turn will cause the ends of the latch cord to be pulled in towards the push button actuator, thus releasing the spring latches to which the ends of the latch cord are connected. The button cylinder is preferably key lockable to prevent unauthorized operation (and releasing of the spring latches). The spring latches can be rotary spring latches which, for example, may be located at opposite sides of a tonneau cover.

In a preferred embodiment the passageway in the shaft can be the form of an axial slot and an emergency actuator mechanism can be employed to release the spring latches even if the button cylinder is locked. The emergency actuator mechanism can include a sleeve which is axially positioned around the shaft, the sleeve including opposed holes through which the latch cord extends. Moving the sleeve away from the base of the push button actuator housing by use of a pull cord will cause the sleeve to move the latch cord along the axial slot in the (stationary) shaft and to become extended (lengthened) between the posts, thus releasing the spring latches to which the latch cord is connected. This embodiment is useful, for example, when employed on a tonneau cover where the push button actuator, spring latches and latch cord are not accessible to someone who could become trapped under the cover. A handle attached to the pull cord can be adored with fluorescent paint or fluorescent patches, and it can be removably attached, e.g., by hook and loop fastening means, to the underside of the top of the tonneau cover for easy identification and use.

The invention will now be better understood by reference to the attached drawings, taken in conjunction with the following discussion.

BRIEF DESCRIPTION OF THE DRAWINGS

FIG. 2 is a view of the tonneau cover and side panels of the flatbed truck as seen along line 2-2 in FIG. 1, the push button latch release assembly being shown connected to two rotary spring latches located at respective right and left sides of the tonneau cover;

FIG. 3 is an enlarged view of the rotary spring latch on the left side of the tonneau cover after it has been released by the inventive push button latch release assembly, the tonneau cover being shown lifted off the left side panel of the truck;

FIGS. 6 and 7 show a rear portion of a modified push button actuator when constructed to cooperate with a sleeve of an emergency actuator mechanism, FIG. 6 showing both the push button actuator and the emergency actuator mechanism in an inactive state, and FIG. 7 showing the emergency actuator mechanism activated.

DETAILED DESCRIPTION OF THE PREFERRED EMBODIMENTS

Figures 1, 8:
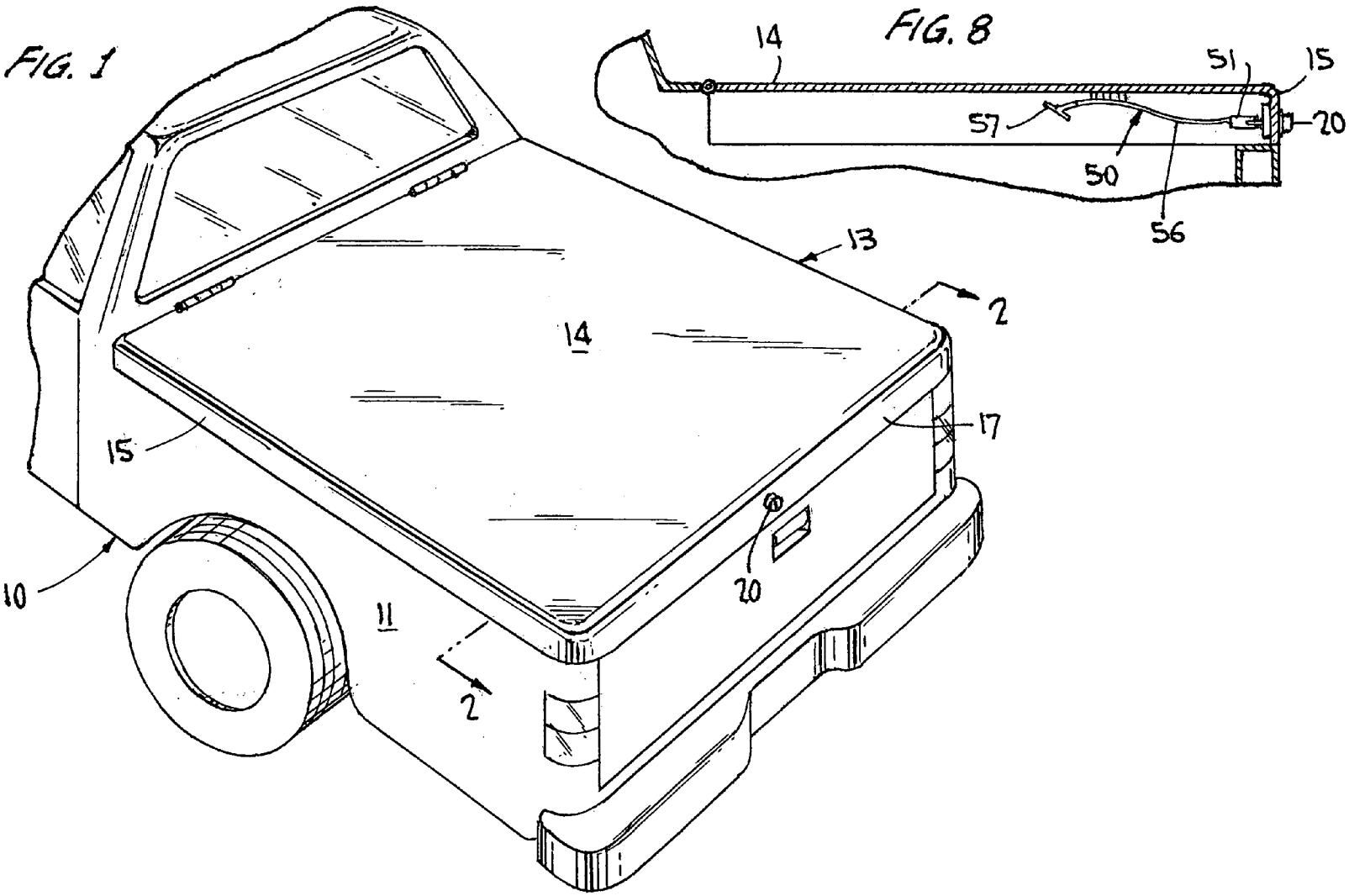
FIG. 1 is a perspective view of rear portion of a flatbed truck showing a tonneau cover positioned over its bed, a push button actuator of the push button latch release assembly of the present invention being shown extending through the rear edge thereof.
FIG. 8 shows a cross section through the tonneau cover showing the emergency actuator mechanism under its top.
Figure 5:
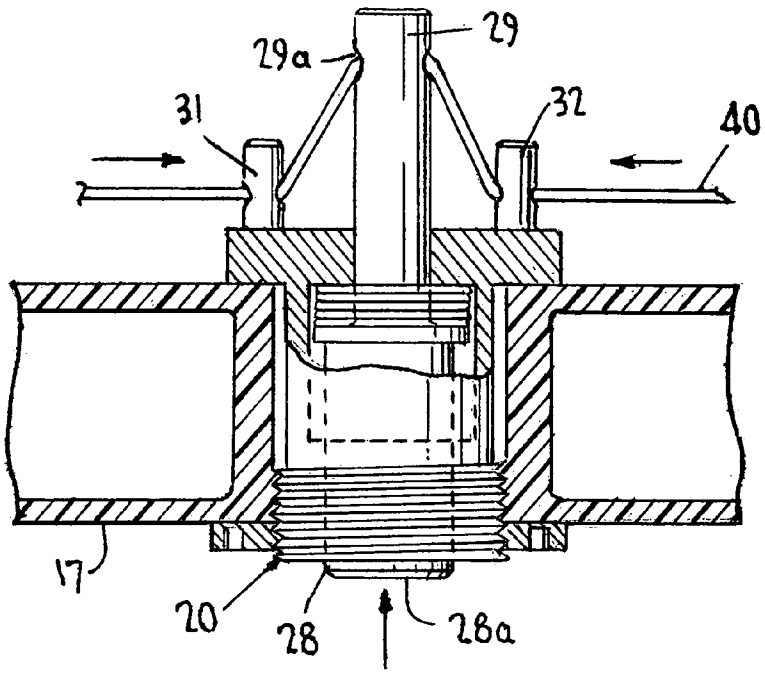
FIGS. 4 and 5 are cross sectional view through the push button actuator of the push button actuator assembly of the invention, FIG. 4 showing the push button actuator in an inactive state and FIG. 5 showing the push button actuator when operated.
Figure 4:
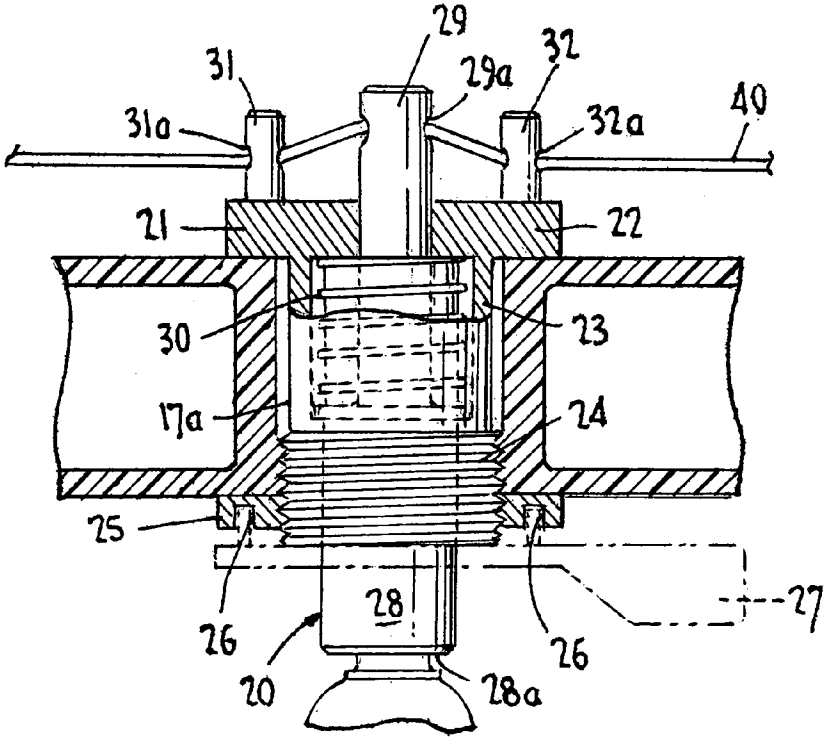

A first preferred embodiment of push button latch release assembly according to the present invention is seen in FIGS. 1, 4 and 5. It includes a push button actuator 20 and a latch cord 40 which is threaded through the push button actuator and connected to two spring latches located on opposite sides of the push button actuator. As shown in FIGS. 1-3, in a preferred application of the push button latch release assembly the push button actuator 20 is located in an opening 17*a* in the rear side 17 of a tonneau cover 13, which is mounted over the bed of a flatbed truck 10. The tonneau cover 13 includes a top 14 and opposite left and right sides 15 and 16. The latch cord 40 connects at its opposite ends to release levers of conventional rotary spring latches 18 and 19 mounted at opposite sides of the tonneau cover and which can respectively lock on brackets 11*a* and 12*a* extending inwardly from the sides 11 and 12 of the truck.

The push button actuator 20 includes a housing 21 having a base 22 and a tubular barrel 23 which extends away from a front side of the base. The end of the barrel 23 remote from the base 22 includes external threads 24. A nut 25 is threadingly engaged with the threads 24. After the barrel 23 has been extended through hole 17*a* and the base 22 has been positioned against the inside surface of the rear side 17, the nut 25 can be tightened around threads 24 to lock the barrel 23 in position. The nut 25 preferably includes opposed blind holes 26 into which pins of a spanner wrench 27 can be placed to tighten or remove the nut (required use of a spanner wrench helps deter unauthorized removal).

A key-lockable button cylinder 20 having an extension shaft 29 is mounted in the barrel 23 of the housing to be axially movable therein, the extension shaft 29 extending through an opening 22*a* in base 22. A spring 30 is located inside the barrel 23 to bias the button cylinder 28 to the inactive position shown in FIG. 4. Pushing the exposed end 28*a* of the button cylinder 28 toward the base 22 will cause it to compress the spring 30 and become actively positioned as shown in FIG. 5. The extension shaft 29 includes a generally cylindrical lateral passageway 29*a* through which the latch cord 40 extends.

Two guide posts 31 and 32 extend from the rear side of base 22 on opposite sides of hole 29*a*, these posts including respective aligned guide channels 31*a* and 32*a* through which the latch cord 40 extends. These guide channels have rounded inlet and outlet orifices (see FIGS. 6 and 7). For optimum operation of the latch release mechanism, it is preferred that the passageway 29*a* of extension shaft 29 be located further from the base 22 than the guide channels 31*a*, 32*a* so that the latch cord will be bowed between the guide holes even when the tubular barrel 23 is in its inactive position.

It can be appreciated that with the latch cord 40 properly extended between the rotary spring latches 18 and 19 and through the push button actuator 20, pushing of the end 28*a* of the button cylinder 28 (when unlocked) will cause the latch cord 40 to be further lengthened between the guide posts 31 and 32 (FIG. 5) and thus drawn in at its ends, consequently moving the release levers of the rotary spring latches 18 and 19 to unlock the tonneau cover 13 (FIG. 3).

According to a second embodiment of the invention, the extension shaft 29' of the key-lockable button cylinder is fabricated to have an axial slot 29*b* therethrough (see FIG. 6) for cooperation with a sleeve 51 of an emergency mechanism 50 (see FIG. 8).

This sleeve includes opposed holes 52, 53 at its end nearest the base 21 and a cap 54 at its opposite end (preferably threadingly engaged with internal threads in the sleeve), the cap including an eye connector 55. The emergency actuator mechanism includes a pull cord 56 connected at one end to the eye connector 55 and to a handle 57 at its opposite end (see FIG. 8). The handle can be painted with fluorescent paint or include a fluorescent patch thereon. The pull cord and/or handle 57 can be removably connected to the underside of the top 14 of the tonneau cover by suitable cooperating hook and loop fastening means, or by other means. A person trapped in the bed of the truck under the tonneau cover can unlock the rotary spring latches 18 and 19, even when the key-lockable button cylinder 28 is locked, by detaching the handle 57 from the tonneau cover and pulling. This will cause the pull cord 56 to draw sleeve 51 from its position in FIG. 6 to the position of FIG. 7. The openings 52 and 53 will pull the latch cord 40 along the slot 29*b* in the shaft 29' (the shaft 29' remains stationary) to further lengthen the latch cord 40 between posts 31 and 32 and unlock rotary spring latches 18 and 19. An emergency actuator mechanism of this nature is important when, for example, the latch cord 40 and rotary spring latches 18 and 19 are located in chambers of the tonneau cover that are not accessible to a person trapped under thereunder (not shown).

Although two embodiments of the invention have now been shown and described in detail, modifications therein can be made and still fall within the scope of the appended claims.

I claim:

1. A push button latch release assembly which includes a push button actuator and a latch cord which extends through said push button actuator and includes at least one end for connection to a spring latch, said push button actuator comprising:

a housing which includes a base having opposite first and second faces and a hole therethrough, a tubular barrel which extends away from said first face and surrounds said hole, and means on a side of said base opposite said tubular barrel which provides first and second guide channels on respective opposite sides of said hole, and a button cylinder which is movably positioned within said tubular barrel and which includes an extension shaft that extends through said hole in said base, said extension shaft including a lateral passageway through which said latch cord extends, pushing of said button cylinder from an inactive position away from said base to an operating position closer to said base causing said passageway in said extension shaft to lengthen said latch cord between said first and second guide channels and draw said at least one end of said latch cord inwardly towards said push button actuator.

2. A push button latch release mechanism according to claim 1, wherein said push button actuator includes a spring in said tubular barrel to bias said button cylinder to said inactive position.

3. A push button latch release mechanism according to claim 2, wherein an end of the barrel remote from said base includes external threads, and including a nut for threadingly engaging said external threads.

4. A push button latch release mechanism according to claim 3, wherein said button cylinder is key lockable.

5. A push button latch release mechanism according to claim 1, wherein said lateral passage in said shaft is generally cylindrical.

6. A push button latch release mechanism according to claim 1, wherein said means forming first and second guide channels on opposite sides of said hole comprises opposed first and second posts which extend away from said base on a side opposite said tubular barrel, said first and second guide posts respectively defining said first and second guide channels therein.

7. A push button latch release mechanism according to claim 1, wherein said first and second guide channels are aligned and said passageway in said extension shaft is located further from said base than said aligned guide channels.

8. A push button latch release mechanism according to claim 1, wherein said passageway is an axial slot.

9. A push button latch release mechanism according to claim 8, including an emergency actuator mechanism operatively connected to said cord, said emergency actuator mechanism comprising a sleeve slidingly positioned around said shaft, said sleeve including opposed holes near a first end thereof through which said latch cord extends, a pull cord attached to a second end of said sleeve, and a pull handle attached to said pull cord, pulling said pull cord by said pull handle causing said sleeve to slide relative to said shaft and said opposed holes therein to extend said latch cord relative to said posts to draw said at least one end of said latch cord inwardly towards said push button actuator.

10. A push button actuator release mechanism according to claim 9, wherein said emergency actuator mechanism includes a screw cap attached to said second end of said sleeve, said screw cap including an eye connector to which said pull cord is attached.

11. A combination of first and second spaced spring latches which are operable to connect a first element to a second element and a push button latch release assembly for unlatching said first and second spring latches, said push button latch release assembly comprising a push button actuator located between said first and second latches and a latch cord which extends through said push button actuator and which is connected at its respective opposite ends to said first and second spring latches, said push button actuator comprising:

a housing which includes a base having opposite first and second faces and a hole therethrough, a tubular barrel which extends away from said first face and surrounds said hole, and two posts which extend away from said second face on opposite sides of said hole, said posts including channels through which said latch cord extends, and a button cylinder which is movably positioned within said tubular barrel and which includes an extension shaft which extends through said hole in said base, said extension shaft including a passageway through which said latch cord extends, pushing of said button cylinder from an inactive position away from said base to an operating position close to said base causing said opening in said extension shaft to extend said latch cord between said posts to draw said ends of said latch cord inwardly towards said push button actuator.

12. A push button actuator which comprises:

a housing which includes a base having opposite first and second faces and a hole therethrough, a tubular barrel which extends away from said first face and surrounds said hole, and two posts which extend away from said second face on opposite sides of said hole, said posts including channels through which said cord extends, and a button cylinder which is movably positioned within said tubular barrel and which includes an extension shaft which extends through said hole in said base, said extension shaft including a passageway through which said latch cord extends, pushing of said button cylinder from an inactive position away from said base to an active position close to said base causing said opening in said extension shaft to extend said latch cord between said posts to draw at least one end of said latch cord inwardly towards said push button actuator.

13. A tonneau cover for use with a vehicle, said tonneau cover including a top, left, right and rear sides, left and right spring latches for connecting said tonneau cover to a vehicle, and a push button latch release assembly for unlatching said left and right spring latches when latched to said vehicle, said push button latch release assembly comprising a push button actuator and a latch cord which extends through said push button actuator and is connected at respective opposite ends thereof to said left and right spring latches, said push button actuator comprising:

a housing which includes a base having opposite first and second faces and a hole therethrough, a tubular barrel which extends away from said first face and surrounds said hole, and two posts which extend away from said second face on opposite sides of said hole, said posts including holes through which said cord extends, and a button cylinder which is movably positioned within said tubular barrel and which includes an extension shaft which extends through said hole in said base, said extension shaft including an opening therethrough through which said latch cord extends, pushing of said button cylinder from an inactive position away from said base to an operating position close to said base causing said opening in said extension shaft to extend said latch cord between said posts to draw said opposite ends of said latch cord inwardly towards said push button actuator and release said left and right spring latches.

* * * * *